US010638801B2

(12) United States Patent
Verma et al.

(10) Patent No.: US 10,638,801 B2
(45) Date of Patent: May 5, 2020

(54) BODY GRIPPING HARNESS AND SINGLE POINT CONNECTOR FOR ELECTRICAL RUBBER INSULATING SLEEVES

(71) Applicant: Honeywell International Inc., Morris Plains, NJ (US)

(72) Inventors: Prashant Verma, Telangana (IN); Raj Kamal Prasad, Telangana (IN); Saji George, Hyderabad (IN)

(73) Assignee: Honeywell International, Inc., Morris Plains, NJ (US)

( * ) Notice: Subject to any disclaimer, the term of this patent is extended or adjusted under 35 U.S.C. 154(b) by 356 days.

(21) Appl. No.: 15/465,207

(22) Filed: Mar. 21, 2017

(65) Prior Publication Data

US 2017/0280790 A1 Oct. 5, 2017

(51) Int. Cl.

| | |
|---|---|
| ***A41D 13/08*** | (2006.01) |
| ***A41D 13/008*** | (2006.01) |
| ***A41D 27/10*** | (2006.01) |
| ***A41F 1/02*** | (2006.01) |
| ***A41F 19/00*** | (2006.01) |

(52) U.S. Cl.

CPC ..... *A41D 13/008* (2013.01); *A41D 13/08* (2013.01); *A41D 27/10* (2013.01); *A41F 1/02* (2013.01); *A41F 19/00* (2013.01); *A41D 2600/20* (2013.01)

(58) Field of Classification Search

CPC ... A41D 13/008; A41D 27/10; A41D 2600/20
See application file for complete search history.

(56) References Cited

U.S. PATENT DOCUMENTS

| | | | | | |
|---|---|---|---|---|---|
| 84,787 | A | | 12/1868 | Adamson | |
| 497,727 | A | * | 5/1893 | Prentiss | A41D 27/10 2/126 |
| 665,668 | A | | 1/1901 | Hollem | |
| 1,117,077 | A | * | 11/1914 | Mooney | A41D 13/08 2/16 |
| 1,751,872 | A | * | 3/1930 | Medaugh | A41D 13/08 2/159 |
| 1,951,437 | A | * | 3/1934 | Parfitt | A41B 1/08 2/269 |
| 2,045,157 | A | * | 6/1936 | Mathias | A41D 13/08 2/16 |
| 2,560,243 | A | * | 7/1951 | Peterson | A61F 5/3746 602/4 |
| 2,693,598 | A | * | 11/1954 | Young | A41D 13/08 2/16 |
| 2,880,731 | A | * | 4/1959 | Kendall | A41C 3/08 450/30 |

(Continued)

*Primary Examiner* — Richale L Quinn
(74) *Attorney, Agent, or Firm* — Alston & Bird LLP

(57) ABSTRACT

A harness (10) is provided for retaining a pair of electrical rubber insulating workman sleeves (12) on the shoulders (14) of a worker (16). The harness (10) is configured to grip a portion of the worker and thereby provide better anchoring of the electrical rubber insulating sleeves (12) to the worker. The gripping feature of the harness (10) is provided either in the form of a gripping collar (24) or a pair of fabric gripping sleeves (26), or a combination of the collar (24) and sleeves (26). Further, a C-shaped connector is configured for attaching the electrical rubber insulating sleeves (12) to a single point on a harness, which allows for an increased range of motion of the sleeves (12).

13 Claims, 4 Drawing Sheets

(56) References Cited

U.S. PATENT DOCUMENTS 3,548,818 A 12/1970 Kaplan
4,016,027 A * 4/1977 Kintanar ..... A41D 19/00 2/159
4,229,833 A * 10/1980 Cox ..... A41D 13/08 2/16
5,173,967 A * 12/1992 Carter ..... A41D 13/0543 2/16
5,638,546 A * 6/1997 Vita ..... A41D 13/08 2/16
6,223,565 B1 * 5/2001 Cooper ..... A41D 13/08 66/172 E
6,360,372 B2 * 3/2002 Oster ..... A41B 1/00 2/125
6,543,661 B1 4/2003 Lazur
7,028,342 B1 * 4/2006 Nordstrom ..... A41D 1/04 2/119
7,066,784 B2 * 6/2006 Peay ..... A41C 3/08 2/16
7,343,629 B2 * 3/2008 Hunt ..... A41D 1/22 2/93
7,429,206 B2 * 9/2008 Perry ..... A41B 9/06 2/109
8,011,020 B2 * 9/2011 Vereen ..... A41B 1/08 2/69
8,075,366 B1 * 12/2011 Jaksic ..... A41C 3/08 2/105
8,418,897 B1 * 4/2013 Young ..... A47D 13/025 224/158
8,808,212 B1 8/2014 Redmond
8,914,913 B2 * 12/2014 Jones ..... A41D 13/0005 2/102
9,027,164 B2 * 5/2015 Seiler ..... A41D 1/22 2/16
D749,822 S * 2/2016 Poole, Jr. ..... D2/828
9,265,289 B1 * 2/2016 Green, Jr. ..... A41B 13/00
9,295,291 B2 * 3/2016 Blakely ..... A41D 13/08
9,763,822 B2 * 9/2017 Pelaez ..... A61F 5/055
10,004,974 B1 * 6/2018 Schneider ..... A63B 71/1225
10,327,484 B2 * 6/2019 Giangeruso ..... A41D 15/002
2007/0250984 A1 11/2007 Whitmire
2009/0265828 A1 10/2009 Semba et al.
2013/0191966 A1 * 8/2013 Rivkin ..... A41D 13/008 2/243.1
2017/0135413 A1 5/2017 Young et al.
2017/0203191 A1 * 7/2017 Lemieux ..... A63B 71/12
2017/0229044 A1 * 8/2017 Benson ..... G09B 23/34
2017/0280790 A1 * 10/2017 Verma ..... A41F 1/02
2018/0116544 A1 * 5/2018 Yuen ..... A61B 5/04085
2019/0142085 A1 * 5/2019 Wilson ..... A41D 13/0568 2/328

* cited by examiner

BODY GRIPPING HARNESS AND SINGLE POINT CONNECTOR FOR ELECTRICAL RUBBER INSULATING SLEEVES

CROSS-REFERENCE TO RELATED APPLICATIONS

This application claims priority of Indian Provisional Appln. No. 201611011561, filed on Apr. 1, 2016 entitled "Body Gripping Harness and Single Point Connector for Electrical Rubber Insulating Sleeves", which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FIELD

This disclosure relates to personal protective equipment used by workers ("linemen") who work on power lines and other electrical equipment, and more particularly, to electrical rubber insulating sleeves that are worn by such workers to protect the workers from electrical shock, and to the harnesses or other structure utilized to retain such electrical rubber insulating sleeves on a worker during use.

BACKGROUND

It is known to provide line workers ("linemen") who work on power lines and other electrical equipment with a pair of electrical rubber insulating sleeves in order to protect the workers from electrical shock. Conventionally, such insulating sleeves are retained on the worker with either a pair of straps that allow a worker's head to extend between the straps, or by some type of harness. One common complaint by workers is that the straps/harnesses are uncomfortable while wearing the insulating sleeves, with the complaints including that the straps/harnesses ride up on the neck and choke the worker, the strap/harness limit the range of motion of the line worker while wearing the rubber insulating sleeves, the straps/harnesses do not allow for a proper fit over the shoulders and chest and/or that the straps/harnesses require frequent adjustment of the insulating sleeves, especially when the arms of the worker are extended. The limitation on the range of motion can also result in binding that can break off the buttons or other fasteners that are used to connect the insulating sleeves to the strap/harness. Clearly, there is room for improvement that would address one or more of the above listed complaints.

SUMMARY

As one feature, a harness is provided for retaining electrical rubber insulating sleeves on a worker, with the harness being made from fabric.

In a further feature, the harness includes an elasticized/elastic material.

In one feature, the harness includes elasticized grips on the arms.

According to one feature, the harness is designed to transfer the load/weight of the electrical rubber insulating sleeves over the shoulders of a worker wearing the harness.

As one feature, the harness includes an adjustable back design to fit different body sizes.

In one feature, the harness ensures firm attachment of the electrical rubber insulating sleeve to the shoulders of a worker wearing the harness.

According to one feature, the harness includes a C-connector unit attached to each rubber sleeve, with the C-connector unit including two attachment points to the rubber sleeve and a single attachment point to the harness.

As one feature, the harness includes a single point attachment for each of the insulating rubber sleeves.

In one feature, the harness is provided with an adjustable neck grip anchoring that grips the neck of a worker wearing the harness.

In accordance with one feature of this disclosure, a harness is provided for retaining a pair of electrical insulating workman sleeves on the shoulders of a worker. The harness includes a pair of fabric shoulder portions configured to extend around at least part of the shoulders of a worker wearing the harness; a pair of fastener features, each fastener feature configured for attaching an electrical insulating sleeve to a corresponding one of the shoulder portions; a connection portion extending from one shoulder portion to the other to limit the motion of the shoulder portions relative to each other; and at least one of: (a) a collar configured to grip the neck of a worker wearing the harness, or (b) a pair of fabric sleeves configured to extend over at least the shoulders and upper arms of a worker, each of the sleeves configured to grip at least a portion of the corresponding upper arm of the worker.

As one feature, each fastener feature is at least one of a button or a button hole.

In one feature, each fastener feature is an array of buttonholes.

According to one feature, each array of buttonholes includes a linear array of buttonholes on the front of the sleeve and a linear array of buttonholes on the back of the sleeve.

As one feature, the harness further includes a C-shaped connector including: a first fastener feature for attaching the C-shaped connector to one of the sleeves, and a pair of second fastener features for attaching an electrically insulating sleeve to the C-shaped connector, and wherein the first fastener feature is located centrally on the C-shaped connector, and each second fastener feature is located on an opposite end of the C-shaped connector from the other second fastener feature. In a further feature, the first fastener feature is a buttonhole, and each of the second fastener features are buttons.

According to one feature, the connection portion includes a resilient material that allows limited movement of the shoulder portions relative to each other.

As one feature, the harness includes the pair of fabric sleeves configured to extend over at least the shoulders and upper arms of a worker, with each of the sleeves configured to grip at least a portion of the corresponding upper arm of the worker.

In one feature, the connection portion is a back side connection portion extending from the back side of one sleeve to the back side of the other sleeve to connect the sleeves to each other.

According to one feature, the back side connection portion includes a resilient material that allows limited movement of the sleeves relative to each other.

As one feature, a front side connection portion extends from the front side of one sleeve to the front side of the other sleeve to connect the sleeves to each other.

In one feature, the front side connection member includes a resilient material that allows limited movement of the sleeves relative to each other.

According to one feature, each of the sleeves includes an elastic band that extends around the upper arm of a worker when the harness is worn by a worker.

As one feature, a collar is provided that extends around the neck of a worker when the harness is worn by the worker, the collar including an adjustment feature for adjusting the fit of the collar around a workers neck.

In one feature, the adjustment feature is a pair of mating hook and loop strips, and the collar has an open front, with one of the hook and loop strips on one side of the open front and the other of the hook and loop strips on the other side of the open front, and with the hook and loop strips being connectable to each other to close the open front of the collar while also adjusting the fit of the collar around the neck of a worker wearing the harness.

According to one feature, a C-shaped connector is provided for connecting an electrical insulating sleeve to a harness worn by a worker. The C-shaped connector includes a first fastener feature for attaching the C-shaped connector to the harness, a pair of second fastener features for attaching an electrical insulating sleeve to the C-shaped connector, and wherein the first fastener feature is located centrally on the C-shaped connector, and each second fastener feature is located on an opposite end of the C-shaped connector from the other second fastener feature. In a further feature, the first fastener feature is a buttonhole, and each of the second fastener features are buttons.

It should be appreciated that a harness according to this disclosure may include only some of the above features, only one of the above features, and/or any combination of the above features.

Other features and advantages will become apparent from a review of the entire specification, including the appended claims and drawings.

DETAILED DESCRIPTION

Figure 4:
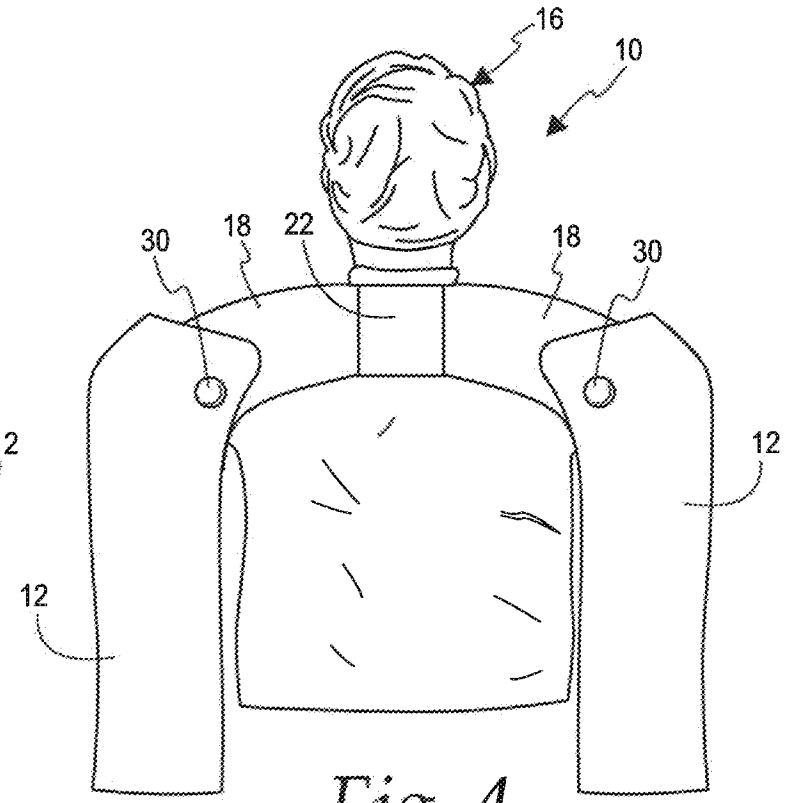
FIG. 4 is a view from the back showing the harness, worker and connected electrical rubber insulating sleeves of FIG. 3.
Figure 3:
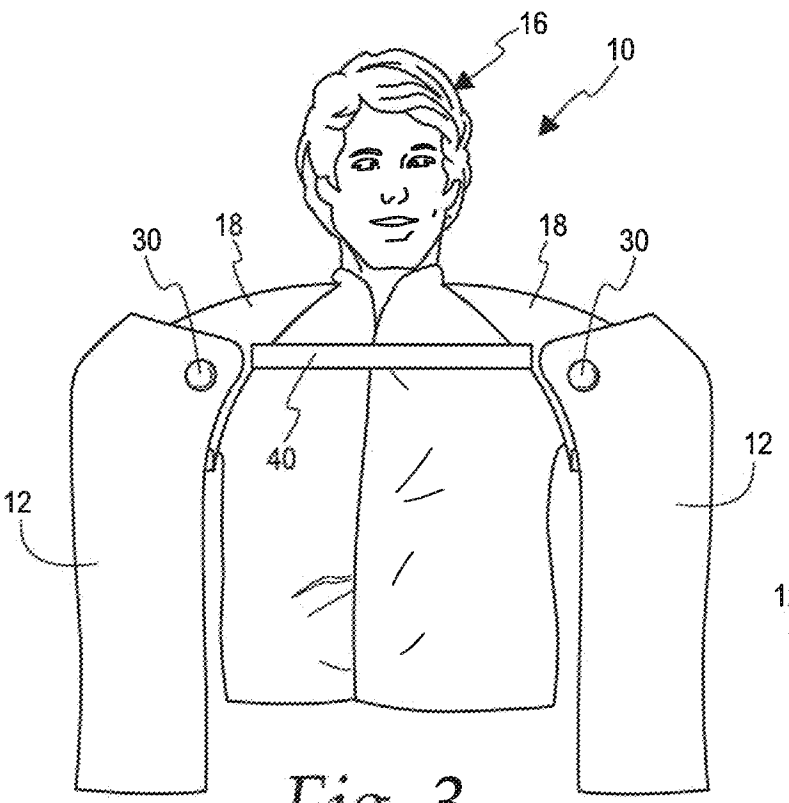
FIG. 3 is a front view of the harness and worker of FIG. 1, and showing a pair of electrical rubber insulating sleeves attached to the harness.
Figure 6:
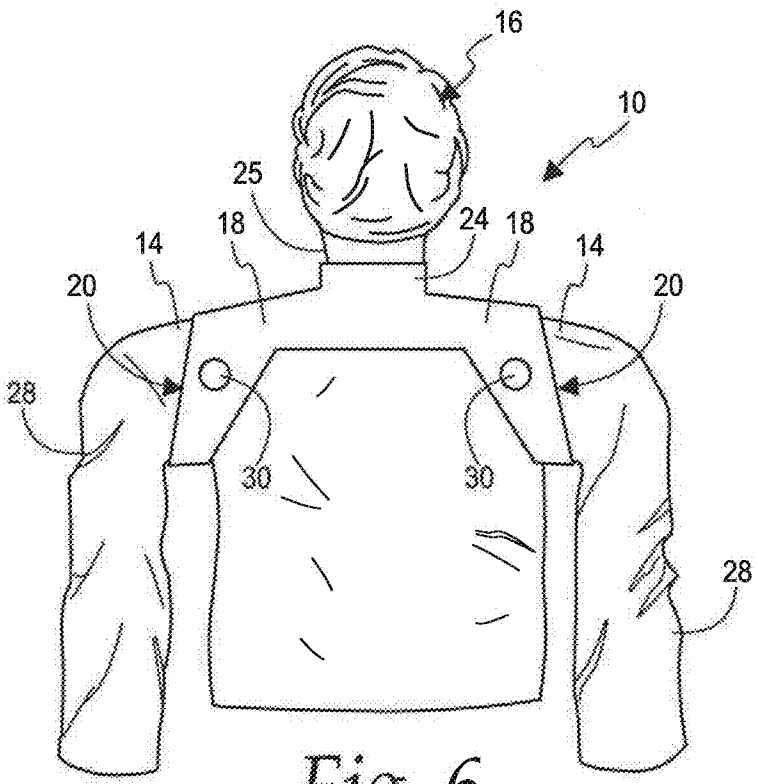
FIG. 6 is a view from the back of the harness and worker of FIG. 5.
Figure 5:
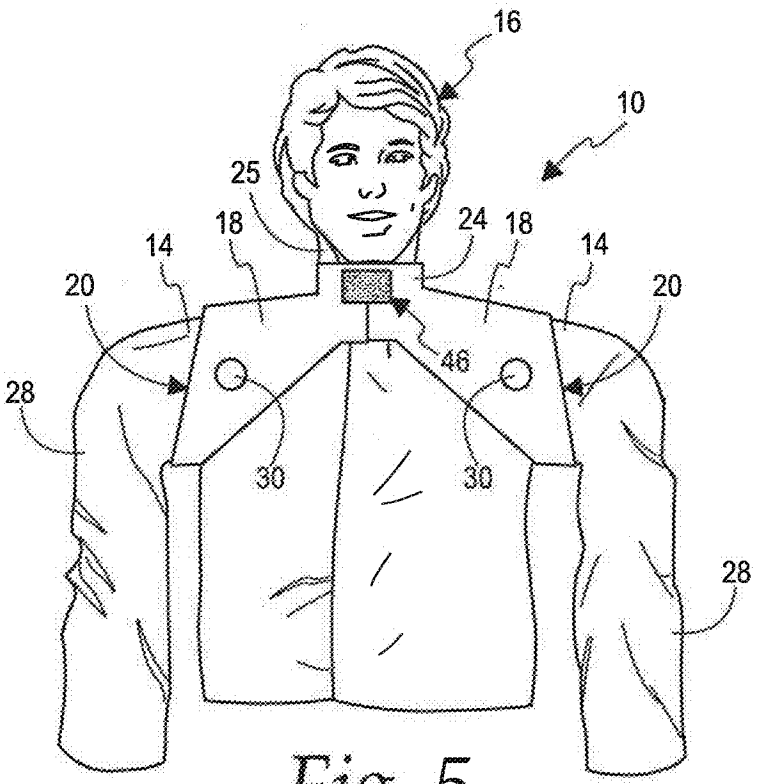
FIG. 5 is a view from the front of another embodiment of the harness as disclosed herein, with the harness again shown as worn by a worker.
Figure 7:
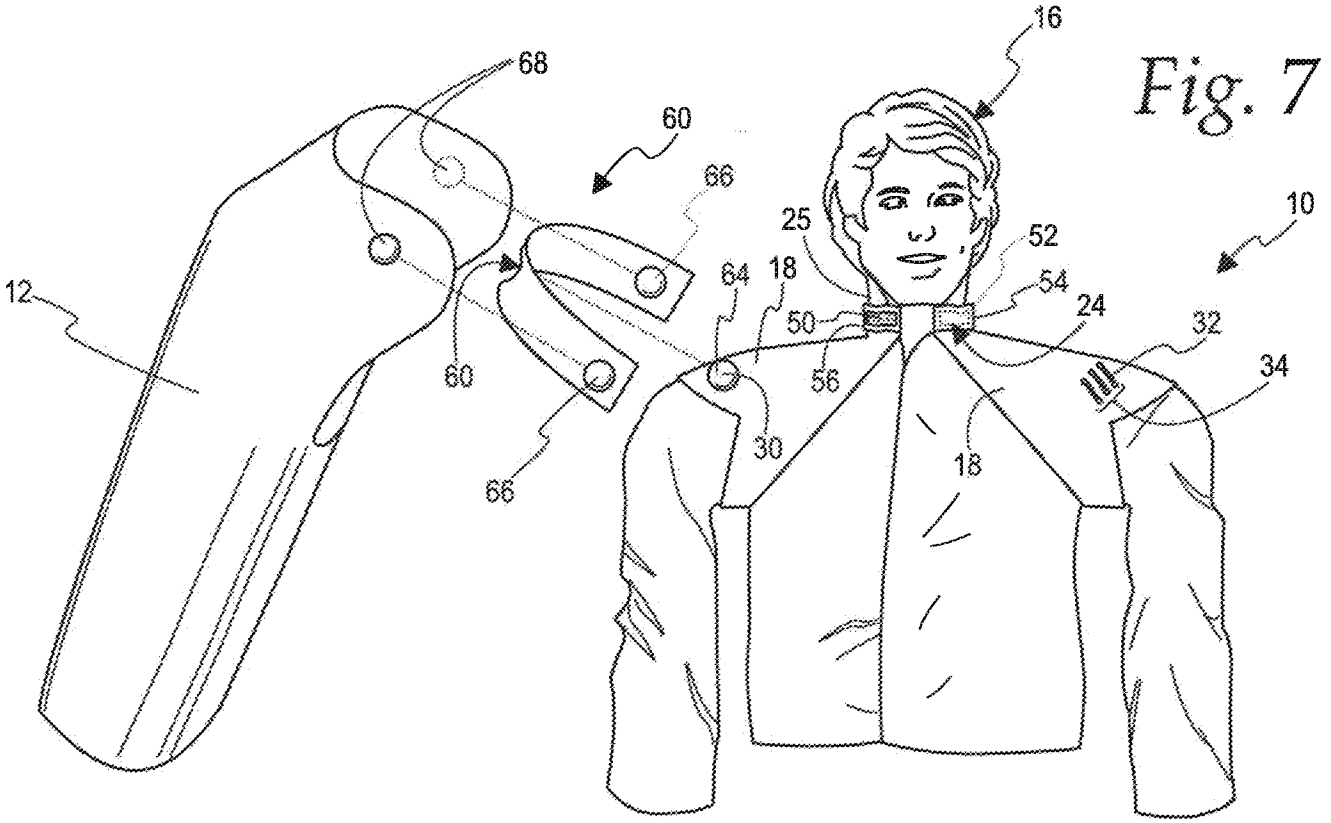
FIG. 7 is a front view of a modified embodiment of the harness of FIGS. 5 and 6 showing a collar feature of the harness of FIGS. 5 and 6 in an open position, and further showing a rubber insulating sleeve and C-shaped connector for connecting the electrical rubber insulating sleeve to a single fastener feature on the harness.

As best seen in FIGS. 1-7, a harness 10 is provided for retaining a pair of electrical rubber insulating workman sleeves 12 on the shoulders 14 of a worker 16. The harness 10 includes a pair of fabric shoulder portions 18 configured to extend around at least part of the shoulders 14 of the worker 16 when the worker 16 is wearing the harness 10. The harness 10 further includes a pair of fastener features, shown generally at 20, with each fastener feature 20 configured for attaching an electrical rubber insulating sleeve 12 to a corresponding one of the shoulder portions 18. The harness 10 further includes a connection portion, shown generally at 22, extending from one shoulder portion 18 to the other shoulder portion 18 to limit the motion of the shoulder portions 18 relative to each other. The harness 10 further includes at least one of: (a) a collar 24 configured to grip the neck 25 of the worker 16, as shown by the embodiments of FIGS. 5-7, or (b) a pair of fabric sleeves 26 configured to extend over at least the shoulders 14 and upper arms 28 of the worker 16, as shown by the embodiment of FIGS. 1-4, with each of the sleeves 26 configured to grip at least a portion of the corresponding upper arm 28 of the worker 16.

Figure 2:
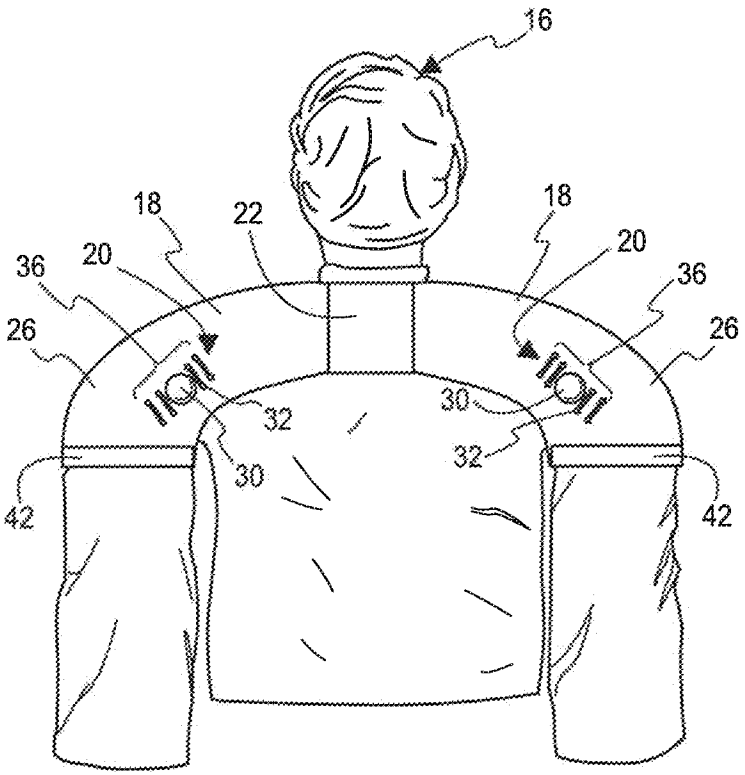
FIG. 2 is a back view of the harness and worker of FIG. 1.
Figure 1:
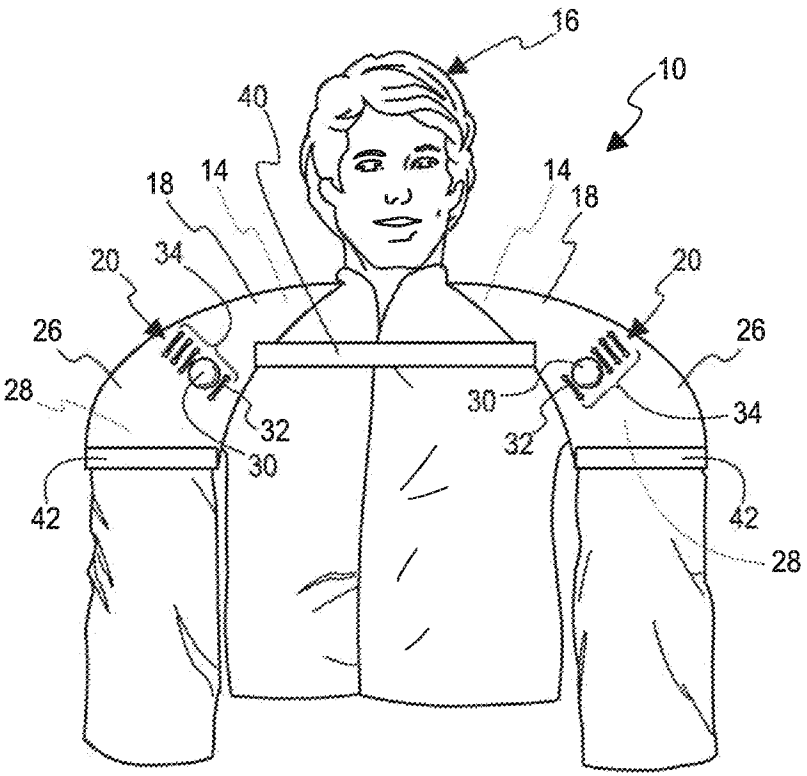
FIG. 1 is a view from the front of one embodiment of a harness as disclosed herein, and showing the harness as worn by a worker.

As best seen in FIGS. 1 and 2, each fastener feature 20 can include at least one of a button 30 or a buttonhole 32, and in the illustrated embodiment, the fastener feature 20 includes an array of buttonholes 32 in the form of a linear array 34 of buttonholes on the front of the sleeve and a linear array 36 of buttonholes on the back of the sleeve. In this regard, it is important to understand that each fastener feature 20 can be just one buttonhole 32 or just one button 30 even though the embodiment of FIGS. 1 and 2 shows the arrays 34 and 36 of buttonholes and two of the buttons 30 for each of the fastener features 20 which will be advantageous in many applications. Additionally, it is important to understand that while the illustrated embodiment shows one possible set of arrays 34 and 36 that will be advantageous in many applications, other arrays of buttonholes are contemplated within the scope of this disclosure and no limitation to the illustrated arrays is intended unless expressly recited in an appended claim. Although the illustrated embodiment will be advantageous in many applications because the buttons 30 are utilized to fasten many conventional electrical rubber insulating gloves that are currently commercially available, it should be understood that other suitable fasteners can be utilized for the fastener features 20, including, but not limited to, snap buttons and/or hook and loop fasteners.

As seen in FIGS. 2 and 4, the connection portion 22 can be provided as a separate component that is attached, such as by stitching, to each of the shoulder portions 18, and preferably is formed from a resilient material that allows limited movement of the shoulder portions 18 relative to each other and particularly allows limited lateral movement of the shoulder portions 18 towards and away from each other. In this regard, the connection portion 22 can be provided in the form of an elasticized band, a plurality of elasticized bands, a section of elasticized fabric material, a stretchable woven fabric material, a foam material, a webbed material, and/or other suitable resilient materials or fabrics. Further in this regard, it is preferred that the resiliency, sizing and shape of the connection portion allow for up to 7 inches of lateral movement of one shoulder portion 18 relative to the other shoulder portion 18. The resiliency of the connection portion 18 allows for a single size of the harness 10 to fit all, or nearly all sizes of workers 16, including workers 16 with odd body sizes, and further allows a wide range of motion for the arms of a worker 16 without undue binding of the harness 10 while retaining the electrical rubber insulating sleeves 12 in their desired position on the arms of the worker 16.

Alternatively, as shown in FIG. 6, the connection portion 22 can be an integral part of the fabric shoulder portions 18 (i.e., a continuation of the fabric portions 18 extending from one fabric shoulder portion 18 to the other fabric portion 18). In this regard, if the fabric of the shoulder portions 18 has some resiliency, the connection portion 22 will be resilient and can be configured to allow the same limited movement of the shoulder portions 18 relative to each other as the harness embodiment of FIGS. 1-4. On the other hand, if the fabric of the shoulder portions 18 is not resilient, the connection portion will not be resilient.

As best seen in FIG. 1, the harness 10 can also include a front-side connection portion 40 that extends from the front-side of each of the sleeve portions 18 to connect the sleeve portions 18. In this regard, the connection portion 40 can be fixed to the sleeve portions 18 using any suitable means, such as by stitching. Again, it is advantageous for the front-side connection portion 40 be formed from a resilient material to allow limited movement of the shoulder portions 18 relative to each other. In the embodiment of the harness 10 shown in FIG. 1, the front-side connection portion 40 is a separate component that is attached to the front-side of each of the sleeve portions 18.

Alternatively, as seen in FIG. 5, the front-side connection portion 40 can be an integrated extension of each of the shoulder portions 18, with the resiliency of the front-side connection portion 40 being dependent upon the resiliency of the fabric forming the shoulder portions 18.

In the embodiment of FIGS. 1-4, it is very advantageous for each of the fabric sleeves 26 to include an elastic band 42 that extends around the upper arm 28 of the worker 16 when the harness 10 is worn by the worker 16. This elastic band 42 provides the desired gripping of the corresponding upper arm 26 of the worker 16. The elastic band 42 can be provided in the form of an elasticized material that is attached to the corresponding sleeve 26, or can have any other suitable structure, such as a gathering of the fabric of the corresponding sleeve 26 adjacent the end of the sleeve 26 with the gathering including an elasticized circumferential stitch or member that allows the gathering to expand and contract resiliently in the circumferential direction around the upper arm 28.

As best seen in FIGS. 5 and 7, in the embodiment that includes a neck gripping collar 24, the collar 24 can include an adjustment feature 46 for adjusting the fit of the collar 26 around the worker's neck 25. In the illustrated embodiments of FIGS. 5-7 and best seen in FIG. 7, the adjusting feature 46 includes a pair of mating hook and loop strips 50 and 52, with the collar 24 being a front opening collar 24. As best seen in FIG. 7, the hook and loop strips 50 and 52 are provided in the form of a first hook and loop strip 50 on one side 54 of the open front, and another hook and loop strip 52 on the other side 56 of the open front, with the hook and loop strips 50 and 52 facing each other so as to be connectable to each other when the open front of the collar 24 is closed as shown in FIG. 5, while also allowing for adjustment of the fit (the circumferential size) of the collar 24 around the neck 25 via the circumferential extending length of each of the hook and loop strips 50 and 52. It should be appreciated that other suitable adjustment features can be utilized within the scope of this disclosure.

As best seen in FIG. 7, a unique C-shaped connector 60 is provided for connecting one of the electrical rubber insulating sleeves 12 to the harness 10. The C-shaped connector 60 is preferably formed from a semi-resilient material, such as a suitable rubber, plastic or composite material, and includes a first fastener feature 62 for attaching the C-shaped connector 60 to a single point 64 on the harness 10, and a pair of second fastener features 66 for attaching the electrical rubber insulating sleeve 12 to the C-shaped connector 60. In the illustrated embodiment, the first fastener feature 62 is provided in the form of a buttonhole 62 that can receive a button 30 of the harness 10, and each of the second fastener features 66 is provided in the form of a button 66 that can be received in corresponding buttonholes 68 provided on the electrical rubber insulating sleeve 12. Again, it should be appreciated that the invention contemplates other fastener features 62 and 66. This C-shaped connector 60 advantageously provides a broader range of motion for the electrical rubber insulating sleeves 72 when worn by a worker 16, without transferring excessive binding loads to the harness 10 worn by the worker 16. It should also be appreciated that while the C-shaped connector 60 is shown in connection with the harness embodiment of FIG. 7, the C-shaped connector 60 can be utilized with all of the embodiments of the harness 10 disclosed herein, and further can be utilized with other types of harnesses that are currently available in the industry or may be available in the industry in the future.

The fabric utilized in making any of the embodiments of the harness 10 disclosed herein can be made out of any suitable woven fabric or material, any suitable foams, any suitable elasticized fabric materials, or any other suitable fabrics.

It should be appreciated that the harness 10 disclosed in FIGS. 1 and 4 grips a worker's 16 body at the arms, which allows a firm grip for the electrical rubber insulating sleeves 12 and provides better anchoring which restricts undesirable movements of the electrical rubber insulating sleeves 12 during use. Furthermore, it should be appreciated that the embodiments of the harness 10 disclosed herein allow for the complete load to be transferred onto the shoulders, which provides better load distribution and comfort during use. It should be further appreciated that the resilient connection portion 22 helps to ensure proper fit to the body of the worker 16, including for a variety of sizes and shapes of workers 16. It should also be appreciated that the arrays 34 and 36 of buttonholes 32 allow for a worker to adjust the positioning of the electrical rubber insulating sleeves 12 to best fit the workers current needs and activities. It should also be appreciated that the elasticized sleeves 26 ensure a grip and proper fit to users with different arm sizes.

The invention claimed is:

1. A harness for retaining a pair of electrical insulating workman sleeves on shoulders of a worker, the harness comprising:

a pair of fabric shoulder portions configured to extend around at least part of the shoulders of a worker wearing the harness;

a pair of fastener features, each fastener feature configured for attaching an electrical insulating sleeve to a corresponding one of the fabric shoulder portions;

a connection portion extending from one fabric shoulder portion to the other fabric shoulder portion to limit a motion of the fabric shoulder portions relative to each other;

at least one of:

(a) a collar configured to grip the neck of the worker wearing the harness, or (b) a pair of fabric sleeves configured to extend over at least the shoulders and upper arms of the worker, each of the pair of fabric sleeves configured to grip at least a portion of a corresponding upper arm of the worker; and a C-shaped connector including:

a first fastener feature for attaching the C-shaped connector to the harness, and a pair of second fastener features for attaching an electrically insulating sleeve to the C-shaped connector, and wherein the first fastener feature is located centrally on the C-shaped connector, and each second fastener feature of the pair of second fastener features is located on an opposite end of the C-shaped connector from the other second fastener feature of the pair of second fastener features.

2. The harness of claim 1 wherein each of the pair of fastener features is at least one of a button or a button hole.

3. The harness of claim 1 wherein each of the pair of fastener features is an array of buttonholes.

4. The harness of claim 3 wherein each array of buttonholes includes a linear array of buttonholes on the front of each of the pair of fabric sleeves and a linear array of buttonholes on the back of each of the pair of fabric sleeves.

5. The harness of claim 1 wherein the first fastener feature is a buttonhole, and each of the pair of second fastener features are buttons.

6. The harness of claim 1 wherein the connection portion includes a resilient material that allows limited movement of the fabric shoulder portions relative to each other.

7. The harness of claim 1 wherein the connection portion is a back side connection portion extending from the back side of one sleeve of the pair of fabric sleeves to the back side of the other sleeve of the pair of fabric sleeves to connect the pair of fabric sleeves to each other.

8. The harness of claim 7 wherein the back side connection portion includes a resilient material that allows limited movement of the pair of fabric sleeves relative to each other.

9. The harness of claim 7 further comprising a front side connection portion extending from the front side of one sleeve of the pair of fabric sleeves to the front side of the other sleeve of the pair of fabric sleeves to connect the pair of fabric sleeves to each other.

10. The harness of claim 9 wherein the front side connection portion includes a resilient material that allows limited movement of the pair of fabric sleeves relative to each other.

11. The harness of claim 1 wherein each of the pair of fabric sleeves includes an elastic band that extends around the upper arm of the worker when the harness is worn by the worker.

12. The harness of claim 1 wherein the collar extends around the neck of the worker when the harness is worn by the worker, the collar including an adjustment feature for adjusting the fit of the collar around the neck of the worker.

13. The harness of claim 12 wherein:

the adjustment feature is a pair of mating hook and loop strips; and wherein the collar has an open front, with one of the pair of mating hook and loop strips on one side of the open front and the other of the pair of mating hook and loop strips on the other side of the open front, with the hook and loop strips being connectable to each other to close the open front of the collar while also adjusting the fit of the collar around the neck of the worker wearing the harness.

* * * * *